US007385189B2

(12) United States Patent
Goodley et al.

(10) Patent No.: US 7,385,189 B2
(45) Date of Patent: Jun. 10, 2008

(54) NANOSPRAY IONIZATION DEVICE AND METHOD

(75) Inventors: Paul C. Goodley, Cupertino, CA (US); Timothy Herbert Joyce, Mountain View, CA (US); Jerry T. Dowell, Carson City, NV (US)

(73) Assignee: Agilent Technologies, Inc., Santa Clara, CA (US)

( * ) Notice: Subject to any disclaimer, the term of this patent is extended or adjusted under 35 U.S.C. 154(b) by 378 days.

(21) Appl. No.: 11/171,976

(22) Filed: Jun. 29, 2005

(65) Prior Publication Data

US 2007/0023676 A1 Feb. 1, 2007

(51) Int. Cl.
*H01J 49/10* (2006.01)

(52) U.S. Cl. ..... 250/288; 250/281; 250/282

(58) Field of Classification Search ..... 250/288, 250/425, 281, 286, 290
See application file for complete search history.

(56) References Cited

U.S. PATENT DOCUMENTS 6,410,914 B1 * 6/2002 Park et al. ..... 250/288
6,462,336 B1 * 10/2002 Bajic ..... 250/288
2002/0060288 A1 * 5/2002 Hughey et al. ..... 250/281
2002/0066857 A1 * 6/2002 Hughey et al. ..... 250/281
2003/0071209 A1 * 4/2003 Park et al. ..... 250/288
2003/0209666 A1 * 11/2003 Hirabayashi et al. ..... 250/288
2005/0056781 A1 * 3/2005 Hirabayashi et al. ..... 250/288
2007/0045532 A1 * 3/2007 Brennen et al. ..... 250/288

OTHER PUBLICATIONS

Inventor(s): Fischer et al., Title: "Multimode Ionization Source", U.S. Appl. No. 10/640,176, filed Aug. 13, 2003.
Inventor(s): Goodley et al., Title: "Nanospray Ion Source With Multiple Spray Emitters", U.S. Appl. No. 11/081,325, filed Mar. 15, 2005.
Inventor(s): Fischer et al., Title: "Apparatus And Method For Sensor Control And Feedback", U.S. Appl. No. 10/067,136, filed Feb. 25, 2005.

* cited by examiner

*Primary Examiner*—Robert Kim
*Assistant Examiner*—Johnnie L Smith, II

(57) ABSTRACT

The present invention provides an apparatus and method for use with a mass spectrometry system. The invention provides an ion source for providing radiative heating to an ionization region. The ion source includes a nanospray ionization device for producing ions and a conduit adjacent to the ionization device for receiving ions from the ionization device. The conduit includes a conductive material for providing indirect radiative heating to the ionization region. Direct radiative heating may also be provided using a heater in the conduit. The ion source may be used separately or in conjunction with the mass spectrometry system. When used in conjunction with a mass spectrometry system a detector may also be employed down stream from the device. A method for desolvating an analyte using the device is also disclosed.

14 Claims, 4 Drawing Sheets

NANOSPRAY IONIZATION DEVICE AND METHOD

BACKGROUND

Mass spectrometers work by ionizing molecules and then sorting and identifying the molecules based on their mass-to-charge (m/z) ratios. Several different types of ion sources are available for mass spectrometers. Each ion source has particular advantages and disadvantages for different types of molecules to be analyzed.

Much of the advancement in liquid chromatography (LC/MS) over the last ten years has been in the development of ion sources. The introduction of techniques that are performed at atmospheric pressure have been of particular interest. These techniques do not require the use of complex pumps and pumping techniques to create a vacuum. Common techniques include and are not limited to electrospray ionization (ESI), atmospheric pressure chemical ionization (APCI), and atmospheric pressure photoionization (APPI).

ESI is the oldest and most studied of the above-mentioned techniques. Electrospray ionization works by a technique that relies in part on chemistry of the molecules to generate analyte ions in solution before the analyte reaches the mass spectrometer. The liquid eluent is sprayed into a chamber at atmospheric pressure. The analyte ions are then spatially and electrostatically separated from neutral molecules.

More recently, there has been a trend toward developing ion sources that use low flow rates and sample amounts. Nanospray devices work by being able to emit small amounts of analyte at low flow rates. At such flow rates the properties effecting molecules are different from standard electrospray techniques. However, at low flow rates and with analyte at very low levels it is often difficult to detect certain ions. It would, therefore, be desirable to provide an apparatus that can detect various ions at very low levels with increased sensitivity. These and other problems have been overcome by the present invention.

SUMMARY OF THE INVENTION

The invention provides a mass spectrometry system, comprising a nanospray ion source for providing radiative heating to an ionization region. The nanospray ion source comprises a nanospray ionization device for producing ions and a conduit adjacent to the ionization device for receiving ions from the ionization device, the conduit comprising a a conductive material for providing radiative heating to the ionization region and a detector downstream from the nanospray ion source for detecting ions produced by the nanospray ion source.

The invention also provides a nanospray ion source for providing radiative heating to an ionization region. The nanospray ion source comprises a nanospray ionization device for producing ions and a conduit adjacent to the ionization device for receiving ions from the ionization device, the conduit comprising a conductive material for providing radiative heating to the ionization region.

The invention also provides a method for heating and desolvating an analyte and sample in an ionization region of a nanospray ion source. The method comprises radiating heat from a conductive conduit into the ionization region and desolvating the analyte in the ionization region.

DETAILED DESCRIPTION

Figure 1:
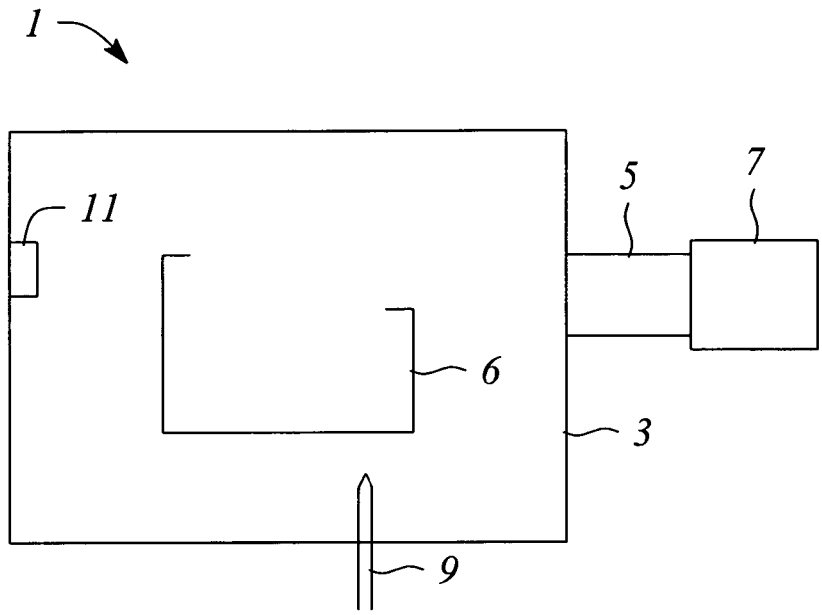
FIG. 1 shows a general block diagram of a mass spectrometry system of the present invention.

Before describing the invention in detail, it must be noted that, as used in this specification and the appended claims, the singular forms "a," "an," and "the" include plural referents unless the context clearly dictates otherwise. Thus, for example, reference to "an emitter" includes more than one "emitter". Reference to a "nanospray ionization device" or a "conduit" includes more than one "nanospray ionization device" or "conduit". In describing and claiming the present invention, the following terminology will be used in accordance with the definitions set out below.

The term "adjacent" means near, next to or adjoining. Something adjacent may also be in contact with another component, surround (i.e. be concentric with) the other component, be spaced from the other component or contain a portion of the other component. For instance, an "emitter" that is adjacent to a electrode may be spaced next to the electrode, may contact the electrode, may surround or be surrounded by the electrode or a portion of the electrode, may contain the electrode or be contained by the electrode, may adjoin the electrode or may be near the electrode.

The term "analyte" refers to any sample including one or more solvents mixed with the sample for analysis.

The term "atmospheric pressure ionization source" refers to the common term known in the art for producing ions. The term has further reference to ion sources that produce ions at ambient temperature and pressure ranges. Some typical ionization sources may include, but are not be limited to electrospray, APPI and APCI ion sources.

The term "charged droplet" or "charged droplet formation" refers to the production of molecules comprising a mixture of analyte, solvent and/or mobile phases.

The term "conductive" or "conductive conduit" refers to an apparatus that is thermally conductive, or may hold or radiate heat.

The term "conduit" refers to any sleeve, capillary, transport device, dispenser, nozzle, hose, pipe, plate, pipette, port, orifice, orifice in a wall, connector, tube, coupling, container, housing, structure or apparatus that may be used to receive or transport ions or gas.

The term "conduit electrode" refers to an electrode that may be employed to direct ions into a conduit. The electrode may be used to collect ions in the conduit for further processing.

The term "corona needle" refers to any conduit, needle, object, or device that may be used to create a corona discharge.

The term "detector" refers to any device, apparatus, machine, component, or system that can detect an ion. Detectors may or may not include hardware and software. In a mass spectrometer the common detector includes and/or is coupled to a mass analyzer.

The term "electrospray ionization source" refers to an emitter and associated parts for producing electrospray ions. The emitter may or may not be at ground potential. Electrospray ionization is well known in the art.

The term "emitter" refers to any device known in the art that produces small droplets or an aerosol from a liquid.

The term "first electrode" refers to an electrode of any design or shape that may be employed for directing ions or for increasing or creating a field to aid in charged droplet formation or movement.

The term "second electrode" refers to an electrode of any design or shape that may be employed to direct ions or for increasing or creating a field to aid in charged droplet formation or movement.

The terms "first electric field", "second electric field" and "third electric field" refer to contributions to the total electric field by individual electrodes as specified. The contribution to the electric field from a particular electrode is regarded as the field due to the charges on that electrode only (and the charges they induce on other electrodes). By the principle of superposition, the total electric field at any point is the sum of the contributions to the field at that point from all the electrodes present with the given applied voltages.

The term "ionization region" refers to an area between any ionization source and the conduit.

The term "ion source" or "source" refers to any source that produces analyte ions.

The term "molecular longitudinal axis" means the theoretical axis or line that can be drawn through the region having the greatest concentration of ions in the direction of the spray. The above term has been adopted because of the relationship of the molecular longitudinal axis to the axis of the conduit. In certain cases a longitudinal axis of an ion source or electrospray emitter may be offset from the longitudinal axis of the conduit (For example if the axes are orthogonal but not intersecting). The use of the term "molecular longitudinal axis" has been adopted to include those embodiments within the broad scope of the invention. To be orthogonal means to be aligned perpendicular to or at approximately a 90 degree angle. For instance, the "molecular longitudinal axis" may be orthogonal to the axis of a conduit. The term substantially orthogonal means 90 degrees±20 degrees. The invention, however, is not limited to those relationships and may comprise a variety of acute and obtuse angles defined between the "molecular longitudinal axis" and longitudinal axis of the conduit.

The term "nanospray ionization source" refers to an emitter and associated parts for producing ions. The emitter may or may not be at ground potential. The term should also be broadly construed to comprise an apparatus or device such as a tube with an electrode that can discharge charged particles that are similar or identical to those ions produced using nanospray ionization techniques well known in the art. Nanospray emitters at low liquid flow rates use flow rates ranging from $0.001\times10_{-9}$ to $5000.0\times10^{-9}$ L/Min. An emitter tip orifice ranges from $5.0\times10^{-6}$ to $50.0\times10^{-9}$ meters in diameter.

The term "nebulizer" refers to any device known in the art that produces small droplets or an aerosol from a liquid.

The term "non-pneumatic" refers to the production of charged droplet formation by some method other than gas flow assistance nebulization. For instance, electric or magnetic fields may be employed to aid in the formation of charged droplets from emitter(s).

The term "pneumatic" refers to the use of gas flow assistance in charged droplet formation.

The term "sequential" or "sequential alignment" refers to the use of ion sources in a consecutive arrangement. Ion sources follow one after the other. This may or may not be in a linear arrangement.

The invention is described with reference to the figures. The figures are not to scale, and in particular, certain dimensions may be exaggerated for clarity of presentation.

FIG. 1 shows a general block diagram of a mass spectrometry system. The block diagram is not to scale and is drawn in a general format because the present invention may be used with a variety of different types of mass spectrometers. A mass spectrometer system 1 of the present invention comprises an ion source 3, a transport system 5 and a detector 7.

The invention in its broadest sense provides an ion source that produces a spectrum at low sample flow rates. The ion source 3 may comprise a variety of different types of ion sources that emit ions. For instance, a nanospray ionization source 4 with low sample flow rates. These ionization sources may in certain instances be different from electrospray ion sources because of the differing physical and chemical properties at the nanoscale level and consequential differences in ion production mechanisms. In addition, often times the low flow rates used in nanospray do not require a gas assist in production of charged droplet formation. These low flow rates, therefore, allow for application of electric or magnetic fields in the formation and collection of charged droplets.

Figure 2:
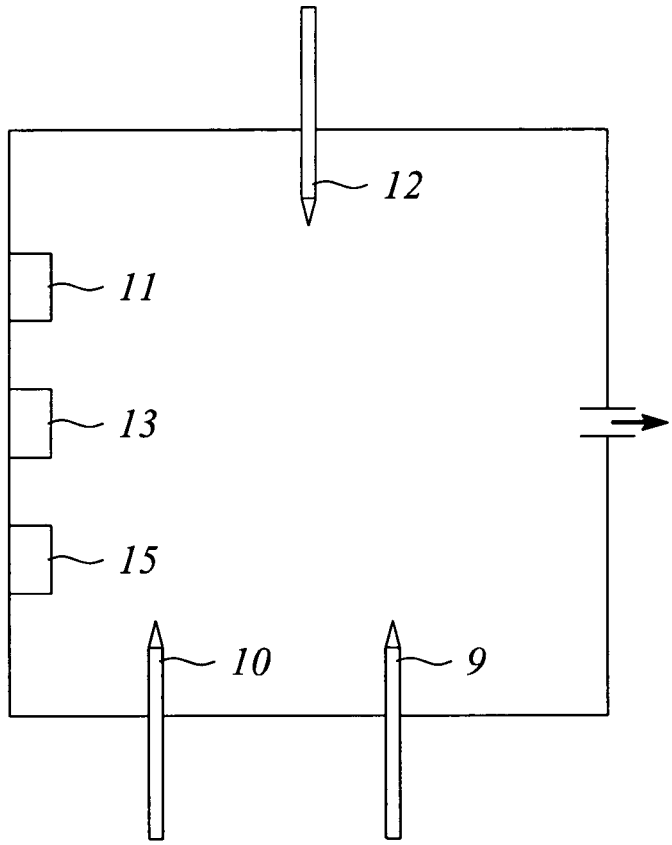
FIG. 2 shows a general block diagram of a second mass spectrometry system.
Figure 3:
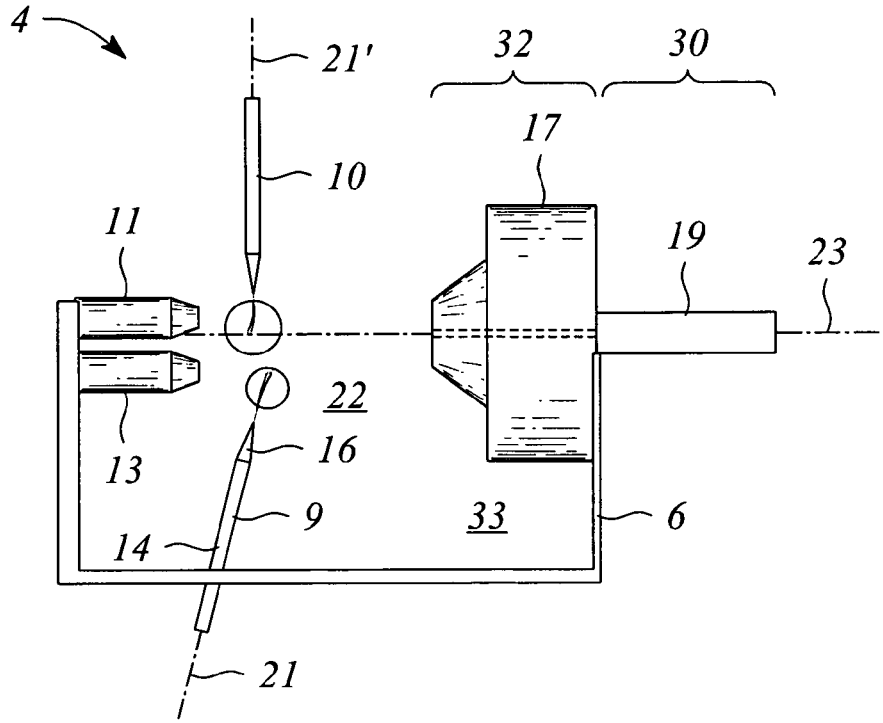
FIG. 3 shows a side elevation of a first embodiment of the invention.

Referring now to FIGS. 1-3, the nanospray ionization source 4 comprises a first emitter 9 and a first electrode 11 adjacent to the first emitter 9. The first emitter 9 and the first electrode 11 may be disposed anywhere in the nanospray ionization source 4. FIG. 1 shows the option of having a housing 6 disposed in the nanospray ionzation source 4. The housing 6 may be designed similar to a faraday cage or shield. In this design a single potential may be applied to the housing 6 so that it acts similar to an electrode. This electrode may then be used in charged droplet formation after the analyte has been emitted from one or more of the emitters. This is not a requirement of the system or nanospray ionization source 4. Other housings, enclosures, electrodes, walls or devices may be employed that are known in the art.

FIG. 2 shows a second general block diagram of the invention. In this embodiment of the invention, additional electrodes and emitters are shown. For instance, the figure shows the first emitter 9, a second emitter 10, and a third emitter 12. Each of the emitters are employed for emitting ions. Each of the emitters 9, 10 and 12 may be placed in various positions in and about the nanospray ionization source 4. In addition, the figure shows the application of a variety of electrodes. For instance, the figure shows the first electrode 11, a second electrode 13 and a third electrode 15. The invention may comprise any number and combination of electrodes and emitters. Note the figure shows the first electrode 11, the second electrode 13, and the third electrode 15 are adjacent to each other. This is not a requirement of the invention. Each of the electrodes and emitters may be placed in various positions and orientations about the housing 6.

FIG. 3 shows a side elevation view of a portion of the present invention. The diagram is not to scale and is provided for illustration purposes only. FIG. 3 shows the ion source 3 in a nanospray configuration. The nanospray ionization source 4 comprises the first electrode 11, the second electrode 13, the first emitter 9, and the second emitter 10. Also displayed is a conduit electrode 17. The first electrode 11 produces a first electric field for moving and directing ions. The conduit electrode 17 is designed for creating a second electric field that collects ions and directs them into transport system 5. Transport system 5 then directs the ions to the mass detector 7 (See FIGS. 1-3).

The first electrode 11, the second electrode 13 and the conduit electrode 17 may be disposed in the housing 6. In other embodiments of the invention the first electrode 11, the second electrode 13 and the conduit electrode 17 may comprise the housing 6. In this embodiment of the invention a single potential is applied to the entire housing 6. The housing 6 may direct ions toward the conduit 19 and/or shield ions from the conduit 19. It should be noted that when the housing 6 is operating like an electrode ions are ejected from the second emitter 10 where they travel toward the bottom of the housing 6. The spray becomes bifurcated due to the strong electric fields produced by the housing 6 or the combination of the conduit electrode 17 with the first electrode 11 and second electrode 13. The process provides overall improved production of charged droplet formation. In addition, the design and process separates gas phase ions from charged droplets that comprise solvent, analyte and/or mobile phase. This is accomplished by the fact that the gas phase ions are shed first from the spray that is emitted from the emitter. They can then be immediately collected, whereas the charged droplets travel in different directions from the conduit 19 or to the bottom of the housing 6 where they are not then collected by the conduit 19. This provides for a simple and effective process for collecting of gas phase ions without the other contaminating charged droplets that would lower overall instrument signal to noise ratio or sensitivity.

More than one emitter may be employed with the present invention. The first emitter 9, the second emitter 10 and the third ion emitter 12 may be disposed anywhere within the housing 6. Each emitter is designed so as to emit ions at low flow rates into the ionization region 22. The emitter 9 comprises a body portion 14 and an emitter tip 16. In FIG. 3 the first emitter 9 and the second emitter 10 are positioned opposite each other. They are also adjacent to the first electrode 11 and the second electrode 13. The conduit electrode 17 may comprise a portion of the conduit 19 or may be separate from the conduit 19. The conduit electrode 17 comprises a body portion 30 and an end portion 32. The conduit electrode 17 may be designed in the form of a flange (See FIG. 3).

In certain instances the end portion 32 of the conduit electrode 17 may be blunt or pointed. In either case, the conduit electrode 17 may be designed to aid in the collection of ions into the conduit 19. The conduit electrode 17 is connected to a voltage source that is designed to create a third electric field (voltage source not shown in diagrams). The conduit electrode 17 creates a third electric field for drawing ions into the conduit 19 for detection by detector 7.

FIG. 3 shows the first electrode 11 and the second electrode 13 in an adjacent position disposed in the nanospray ionization source 4. In FIG. 3 they are also positioned adjacent to the first emitter 9 and the second emitter 10 and opposite the conduit electrode 17. The figure only shows a pair of electrodes. However, a number or plurality of electrodes may be employed with the present invention. The electrodes and emitters may also be positioned in other various locations and directions.

Figure 4:
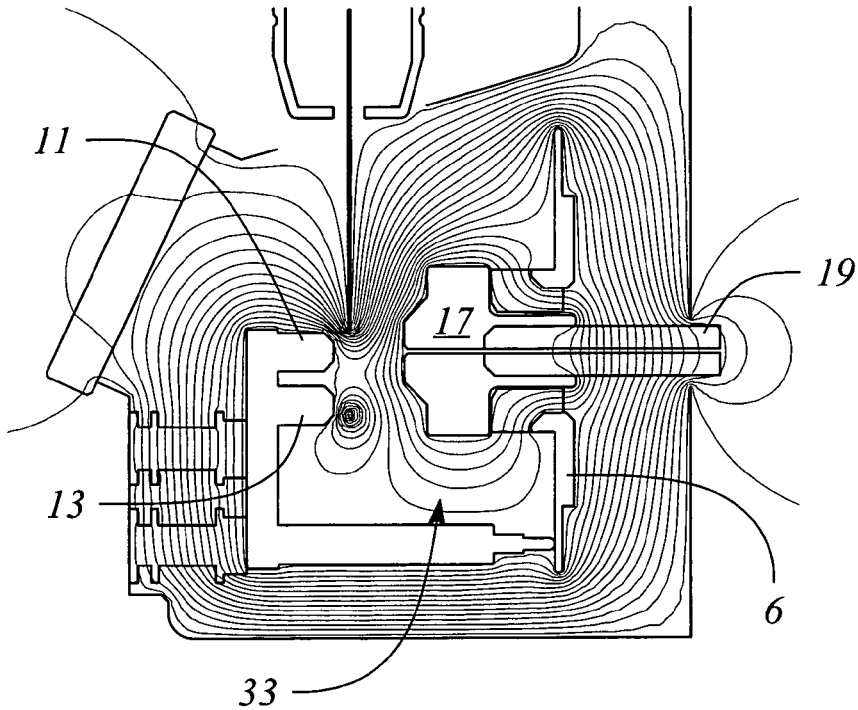
FIG. 4 shows the side elevation view of FIG. 3 with added field lines.

FIG. 4 shows a side elevation of the same embodiment shown in FIG. 3, but with exemplary equipotential lines produced as a result of the electrodes. It should be noted that as the ions are emitted and flow from one or more emitters toward the conduit 19, they are aided by the fields produced by the first electrode 11, the second electrode 13 and the conduit electrode 17. Different potentials may be applied to each of the electrodes. However, when the first electrode 11 and the second electrode 13 are connected to the conduit electrode 17, a single housing is defined. A single potential can be applied to the single housing 6 to aid in the formation and collection of ions from one or more ion emitter. In addition, the housing 6 is designed in such a way that if the ions are not taken into the conduit 19, they pass out of the ionization region 22 (See FIG. 3 and 4) and are collected on various positions on the conduit electrode 17 or circulated to position 33 and can not re-circulate to contaminate the aerosol. In certain instances, these are unwanted ions or ions of a particular mass to charge ratio that are not of interest to the user. This provides for improved overall sensitivity of the device.

Figure 5:
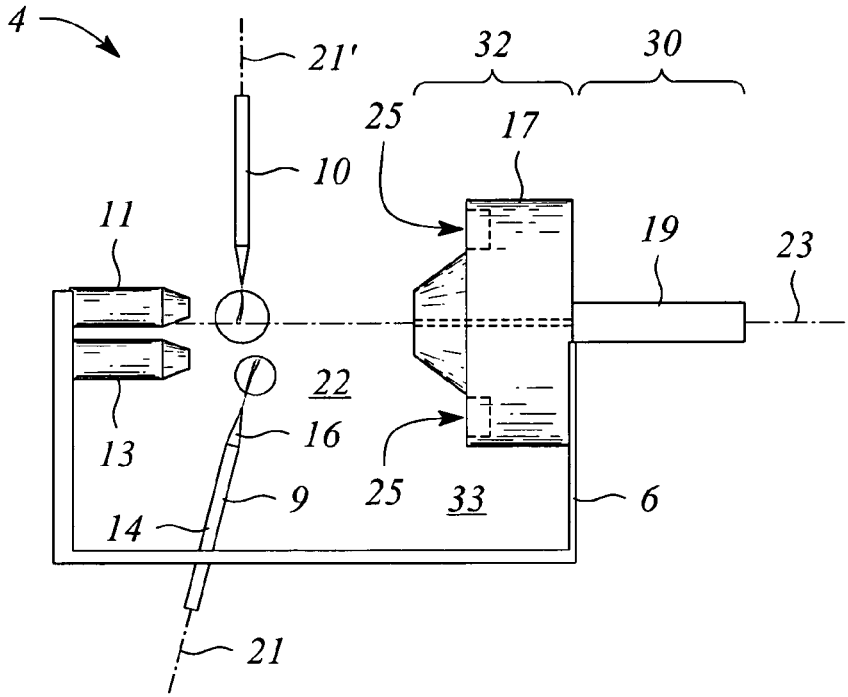
FIG. 5 shows a second embodiment of the present invention.

FIG. 5 shows a second embodiment of the present invention. In this embodiment of the invention an electric heater 25 may be employed with the present invention. The electric heater 25 may be stand-alone or comprise a portion of the conduit electrode 17. The electric heater may also be positioned in any number of directions and may be located in any number of locations in or on the conduit electrode 17. The electric heater 25 may have its own internal voltage source or may be electrically connected to an external source. The electric heater 25 is designed for being able to provide direct irradiation to the ionization region 22. In addition, an optional thermocouple, closed feedback loop, computer and output screen may be in connection with the electric beater 25. This feedback loop would allow for regulation of the amount of radiative heat provided by the electric heater 25 to the ionization region 22. This helps in the regulation of desolvation of the analyte and sample that has been nanosprayed into the area.

Figure 6A:
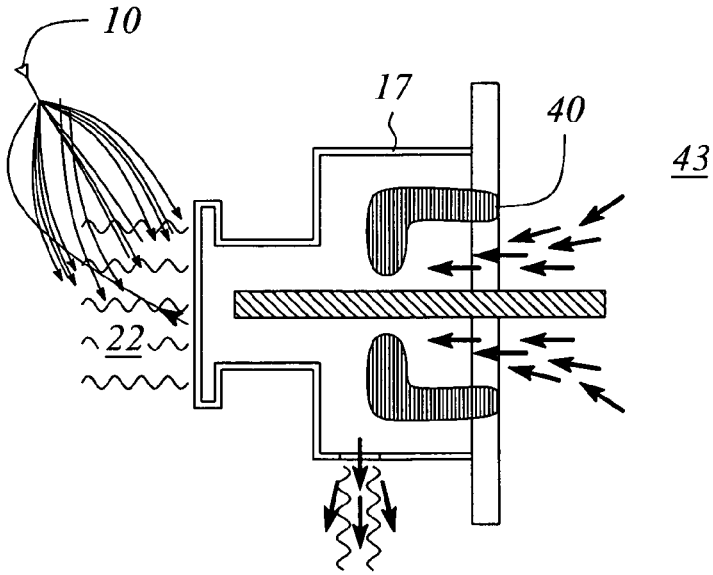
FIG. 6A shows a third embodiment of the present invention.
Figure 6B:
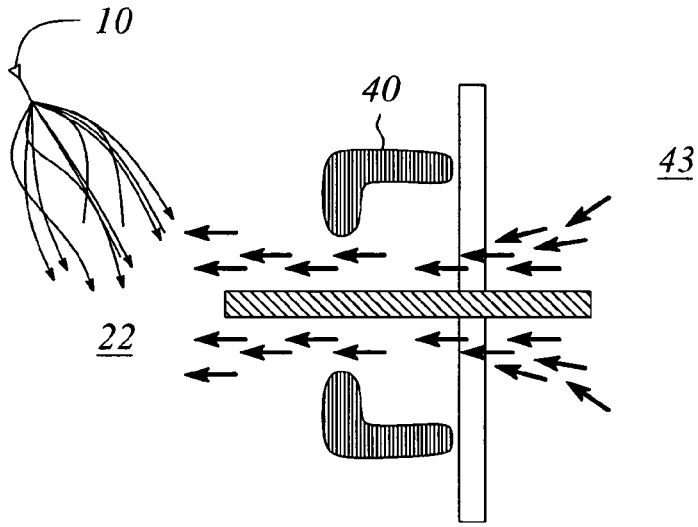
FIG. 6B shows a fourth embodiment of the present invention.

FIGS. 6A and 6B show other embodiments of the present invention. In these embodiments of the invention, a second conduit 40 may be employed with the present invention. The second conduit 40 is designed for receiving and directing heated gas toward the conduit electrode 17 as well as the ionization region 22. The gas travels down the second conduit 40 and exits adjacent to the conduit electrode 17. The heated gas heats the conduit electrode 17 and is conducted toward the end of the conduit so that heat may irradiate into the ionization region 22. The irradiative heating provides for improved desolvation and concentration of the analyte ions that enter the conduit electrode 17.

Figure 7:
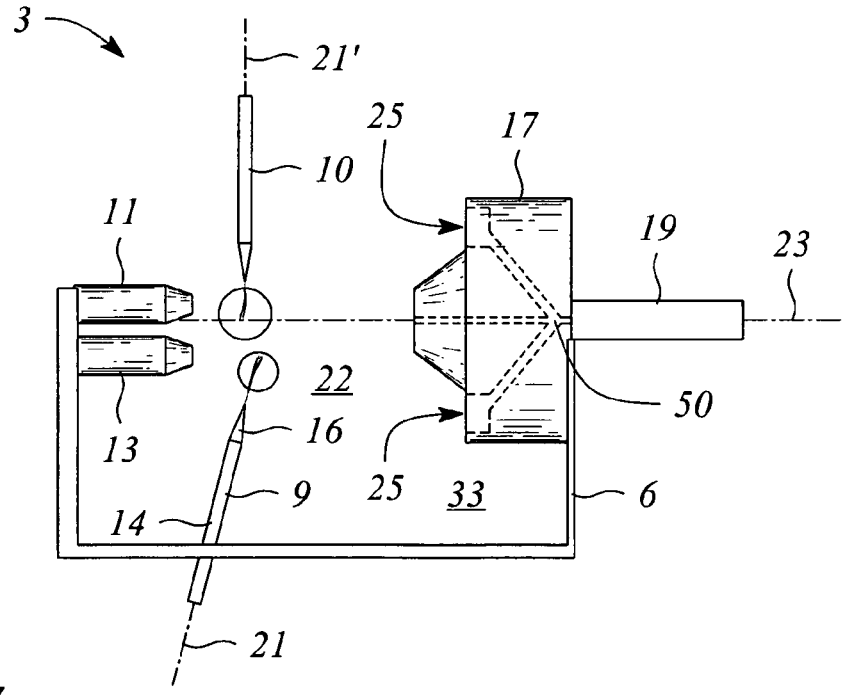
FIG. 7 shows another embodiment of the present invention.

FIG. 7 shows an additional embodiment of the present invention where an additional passageway 50 may be employed to direct heated gas toward the ionization region 22.

Having described the apparatus of the present invention, a description of the method of the present invention is now in order. A few different methods of ionizing the analyte of the present invention are possible. The method of ionizing the analyte in an ionization region of the nanospray ions source comprises applying heat to a conductive conduit and radiating heat from the conductive conduit to desolvate the analyte in the ionization region. A second method comprises radiating heat from the end of a conductive conduit into an ionization region and then desolvating the analyte in the ionization region.

Referring to FIGS. 5-6, the method of the invention will now be described. FIG. 5 shows an embodiment of the invention that employs an electric heater 25. Initially, the sample is introduced into the mass spectrometry system 1. It is then subject to ionization by the nanospray ionization source 4. The analyte typically comprises solvent mixed with a sample. The analyte is subjected to nanospray after it has traveled through the first emitter 10 and has been ejected into the ionization region 22. Once the ions have entered the ionization region 22 they are subject to the electric fields produced by the conduit electrode 17, the first electrode 11, and the second electrode 13. Typically, the analyte that is ejected into the ionization region 22 comprises a large amount of solvent. It is desirable to reduce the solvent as much as possible as the ions are produced from the first emitter 10. This can be accomplished using either a direct or indirect heating methodology. These methods will now be discussed in more detail.

As mentioned, FIG. 5 shows the application of an electric heater 25. The electric heater 25 provides a direct source of heat into the ionization region 22. The irradiated heat then desolvates and dries the analyte and concentrates it before it enters the conduit 19. As mentioned above, an optional feedback loop may also be employed. In this case scenario an optional thermocouple 27, closed feedback loop 29, computer 31 and output screen 35 may be in connection with the electric heater 25 (not shown if FIGS.). This feedback loop would allow for regulation of the amount of radiative heat provided by the electric heater 25 to the ionization region 22. This helps in the regulation of desolvation of the analyte and sample that has been nanosprayed into the area. This is accomplished by the optional thermocouple 27 sensing the surrounding ionization region 22 and then providing feedback to the heater 25 by way of a closed feedback loop 29. A computer 31 and output screen 35 may be employed for a user to interact with the instrument feedback loop. The design and method provides for an efficient way for desolvating and ionizing a sample and analyte.

FIG. 6 shows another embodiment of the present invention and method. In this embodiment of the invention indirect heating and desolvation of the analyte and sample is accomplished. Gas source 43 provides heated gas to the system. The heated gas is injected so as to contact and heat the conduit 19. In particular, the heated gas causes heating of the conduit body portion 30. The heat is then conducted down the conduit body portion 30 to the conduit end portion 32. The conduit end portion 32 then irradiates the excess heat into the ionization region 22 to heat the region as well as the analyte. Typically, this then provides for desolvation of the analyte and sample. This concentrates the ions and improves the overall sensitivity and detection of the instrument.

It is to be understood that while the invention has been described in conjunction with the specific embodiments thereof, that the foregoing description as well as the examples that follow are intended to illustrate and not limit the scope of the invention. Other aspects, advantages and modifications within the scope of the invention will be apparent to those skilled in the art to which the invention pertains.

All patents, patent applications, and publications infra and supra mentioned herein are hereby incorporated by reference in their entireties.

We claim:

1. An ion source for providing radiative heating to an ionization region, comprising:

(a) a nanospray ionization device for producing ions;

(b) a conduit adjacent to the nanospray ionization device for receiving ions from the nanospray ionization device, the conduit comprising a conductive material for providing radiative heating to the ionization region of the ion source, and a flange; and (c) at least one of: (i) a gas source adjacent to the flange for providing heated gas to the flange; and (ii) an electric heater disposed in the flange to provide direct radiative heating to the ionization region.

2. An ion source as recited in claim 1, wherein the flange comprises a conductive material.

3. An ion source as recited in claim 1 wherein the heat provided to the flange conducts through the flange and is radiated into the ionization region to indirectly heat the analyte in the ionization region.

4. A mass spectrometry system, comprising: (a) an ion source for providing radiative heating to an ionization region, comprising: (i) a nanospray ionization device for producing ions; (ii) a conduit adjacent to the nanospray ionization device for receiving ions from the nanospray ionization device, the conduit comprising a conductive material for providing radiative heating to the ionization region, and a flange; and (iii) at least one of: (1) a gas source adjacent to the flange for providing heat to the flange; and (2) an electric heater disposed in the flange to provide direct radiative heating to the ionization region; and (b) a detector downstream from the ion source for detecting ions produced by the ion source.

5. A mass spectrometry system as recited in claim 4, wherein the flange comprises a conductive material.

6. A mass spectrometry system as recited in claim 4, wherein the heat provided to the flange conducts through the flange and is radiated into the ionization region to indirectly heat the ions in the ionization region.

7. A method of ionizing analyte in an ionization region of an ion source, comprising: (a) applying heated gas to a flange of a conductive conduit using a gas source adjacent to the flange; and (b) radiating heat from the conductive conduit to desolvate analyte in the ionization region.

8. A method of desolvating analyte in an ionization region of an ion source, comprising: (a) applying heat to a flange of a conductive conduit using a gas source adjacent to the flange; and (b) radiating heat from the conductive conduit to desolvate the analyte in the ionization region.

9. A method of desolvating an analyte in an ionization region of an ion source, comprising: (a) radiating heat from the end of a conductive conduit into the ionization region using an electric heater disposed in a flange of the conduit; and (b) desolvating the analyte in the ionization region.

10. An ion source as recited in claim 1, further comprising a conduit electrode, wherein the conduit electrode comprises the conduit and an electrode that directs the ions into the conduit.

11. A mass spectrometry system as recited in claim 4, wherein the ion source further comprises a conduit electrode, and the conduit electrode comprises the conduit and an electrode that directs the ions into the conduit.

12. A method as recited in claim 7, further comprising directing ions into the conductive conduit using an electrode of a conduit electrode that also comprises the conductive conduit.

13. A method as recited in claim 8, further comprising directing ions into the conductive conduit using an electrode of a conduit electrode that also comprises the conductive conduit.

14. A method as recited in claim 9, further comprising directing ions into the conductive conduit using an electrode of a conduit electrode that also comprises the conductive conduit.

* * * * *